United States Patent [19]

Elder

[11] Patent Number: 4,498,594

[45] Date of Patent: Feb. 12, 1985

[54] NIPPLE, RING AND CAP DISHWASHER ACCESSORY

[76] Inventor: Ivan R. Elder, 116 Greengate Dr., Columbia, S.C. 29204

[21] Appl. No.: 417,046

[22] Filed: Sep. 13, 1982

[51] Int. Cl.[3] ..... A47F 7/00

[52] U.S. Cl. ..... 211/181; 134/137; 220/19; 211/41; 211/59.1

[58] Field of Search ..... 211/41, 59.1, 57.1, 211/181; 134/137, 200, 147; 220/19

[56] References Cited

U.S. PATENT DOCUMENTS

| | | | |
|---|---|---|---|
| D. 202,569 | 10/1965 | Maslow | D44/29 |
| D. 204,076 | 3/1966 | Maslow | D44/29 |
| D. 213,130 | 1/1969 | Keen | D49/1 |
| D. 254,187 | 2/1980 | Freese | D15/36 |
| 2,059,258 | 11/1936 | Lofstrand | 211/181 X |
| 2,710,617 | 6/1955 | James et al. | 134/183 |
| 3,050,073 | 8/1962 | McMillan | 211/181 X |
| 3,182,854 | 5/1965 | Geller | 220/83 |
| 3,217,890 | 11/1965 | Maslow | 211/41 |
| 3,288,155 | 11/1966 | Swetnam | 134/176 |
| 3,289,683 | 12/1966 | Tomlin | 134/147 |
| 3,451,557 | 6/1969 | Stoddard | 211/41 |
| 3,960,290 | 6/1976 | Yake et al. | 220/19 X |
| 4,046,261 | 9/1977 | Yake | 211/41 |
| 4,238,035 | 12/1980 | Kassanchuk | 211/181 X |
| 4,339,051 | 7/1982 | Crawford | 220/19 X |

*Primary Examiner*—Robert W. Gibson, Jr.
*Attorney, Agent, or Firm*—Benoni O. Reynolds

[57] ABSTRACT

A compartmented, basket-like accessory for washing nipple and cap components of infant-feeding bottles in a conventional automatic dishwashing machine. The accessory can be mounted easily and quickly in the article rack found in most conventional automatic dishwashing machines. The top section and bottom section of the accessory preferably are made of perforated plastic to permit the water to pass through freely during the washing and rinsing cycle. A plurality of smaller nipple compartments are each provided with a vertical, prong-like, nipple positioner, centered to hold the nipples upright during the washing and rinsing cycle. Similarly, a plurality of larger cap and ring compartments are each provided with a vertical, prong-like, cap and ring positioner, centered to hold the caps and rings in a fixed position during the washing and rinsing cycle. The accessory has a removable, snugly fitted, top section which co-operates with the nipple compartments and the cap and ring compartments to retain the nipples on their nipple positioners and the caps and rings on their cap and ring positioners during washing and rinsing. The accessory is provided with front and rear hooks, preferably made of plastic and elastic, to secure the accessory to the article rack, yet permitting easy removal for loading and unloading the nipple, cap and ring components. A pin spacer is provided to keep cap and ring components from nesting when non snap-on caps and rings are being processed.

8 Claims, 6 Drawing Figures

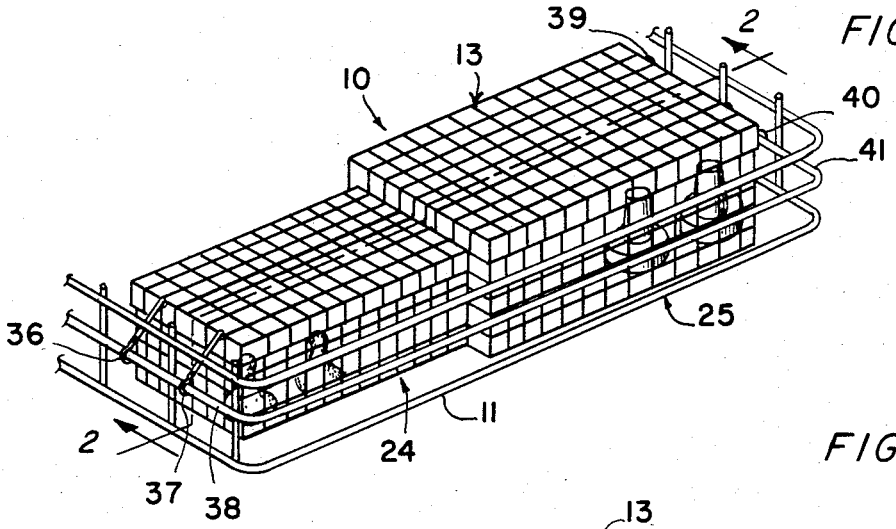
FIG. 1.
FIG. 2.
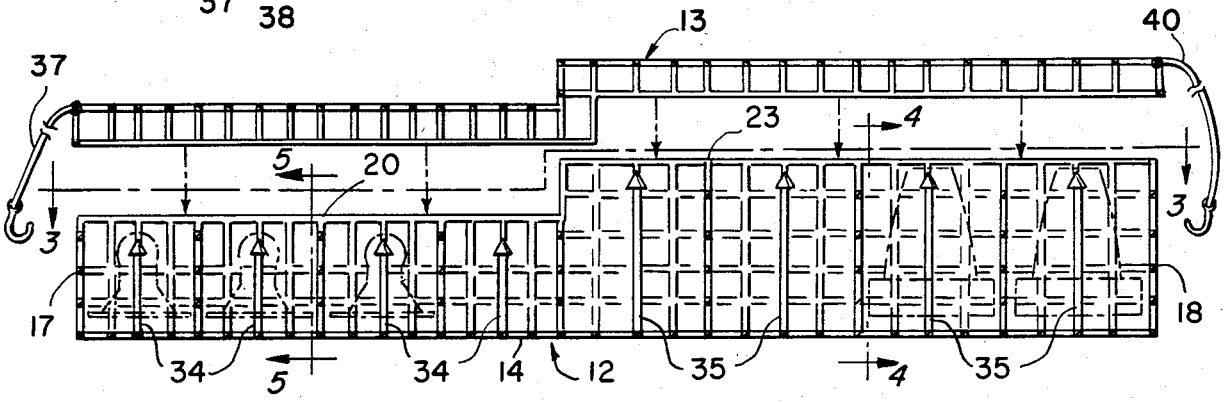
FIG. 3.
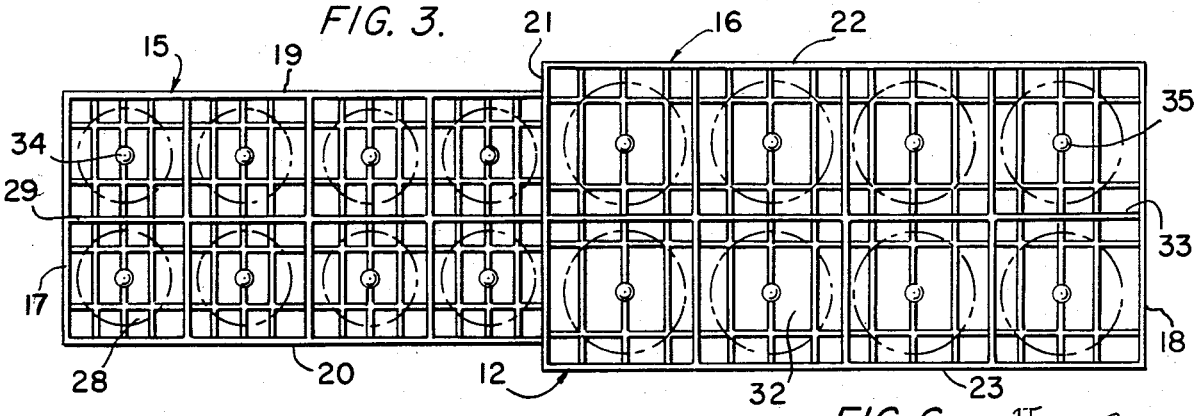
FIG. 4.
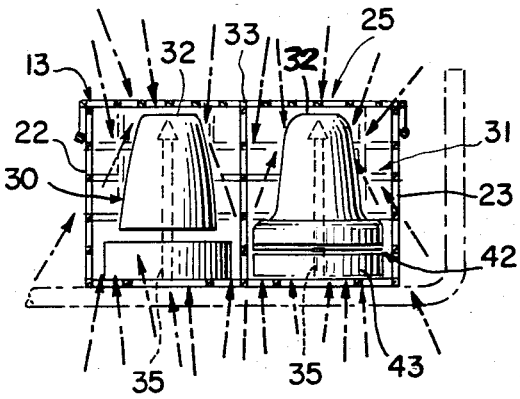
FIG. 5.
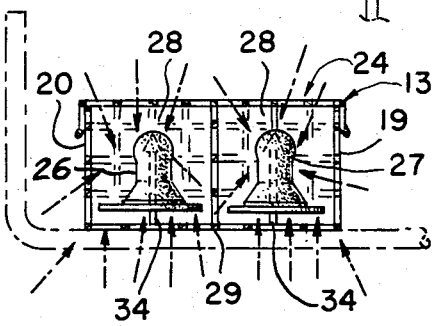
FIG. 6.
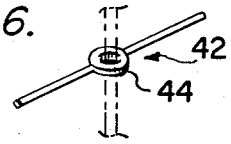

NIPPLE, RING AND CAP DISHWASHER ACCESSORY

BACKGROUND OF THE INVENTION (1) Field of Invention

The present invention relates generally to dishwasher racks or baskets. In particular, it relates to a type of rack which will hold the nipple and cap components of infant nursing or feeding bottles while washing, rinsing and drying the components in a dishwasher.

(2) Description of Prior Art

In the past, to assure that infant feeding bottles were properly sanitized prior to their use, it has been necessary to perform "sterilizing" operations whereby the bottles, as well as the nipple, ring and cap components associated with the bottles, were immersed in boiling water for a period of time. In the alternative, the bottle and these components would be exposed to a pressurized steam atmosphere at temperatures above the boiling point of water. Devices and apparatus associated with these "sterilizing" operations have included covered containers filled with water and adapted to hold bottles and their associated nipple and cap components. Such containers normally were heated on a stove or by an internal electrical heating element to boil the water, thereby producing steam to sterilize the bottle and its components. Also, autoclaves have been used wherein higher sterilizing temperatures may be obtained due to the maintaining of the steam at greater than atmospheric pressure.

While such methods and devices are useful for sanitizing infant feeding bottles, they require special care and attention in use. Also, these devices were relatively expensive to purchase and of limited usefulness as they are seldom used for longer than one year after the birth of an infant when the child is weaned from the bottle.

Manufacturers of automatic dishwashers now offer, as features of some of their machines, special "sanitizing" operating cycles whereby rinse water is heated in the machine to temperatures of 180° Fahrenheit or higher and then circulated through spray washers and onto articles contained in the holding racks of the machine. The advantage of such a "sanitizing" cycle is that rinse water temperatures in excess of those normally provided by the domestic hot water heater may be obtained.

It has been found that the temperatures provided during "sanitizing" rinse cycles or even water temperatures as low as 140° Fahrenheit, can provide quite adequate sanitization of infant feeding bottles and their associated nipple and cap components. In practice a bottle may be placed on a holder in the glassware rack with the open mouth of the bottle usually facing downwardly towards the spray washer apparatus. However, no suitable means presently exists for holding the detached nipple, ring and cap components for washing and sanitization in conventional automatic dishwasher racks. Attempts have been made to hold such nipple and cap components in conventional dishwasher article racks and baskets but these attempts have failed, primarily because such components, being small and light in weight, cannot be maintained in proper position for thorough washing and rinsing. These components are apt to be thrown about inside the machine by the force of the impinging spray from the spray washers. Covered baskets, as known in the prior art, are not suitable for this purpose because they include no provision for securely positioning small, light articles in a proper orientation for thorough washing and rinsing. Similarly, article-positioning devices, intended for use with dishwashing machine racks, are known in the prior art. However, these earlier devices are not suitable for holding the nipple and cap components of infant-feeding bottles. Prior art known to this inventor includes the following U.S. Pat. Nos.:

| | | |
|---|---|---|
| 2,710,617 | 6/1955 | James |
| 3,182,854 | 5/1965 | Geller |
| D 202,569 | 10/1965 | Maslow |
| 3,217,890 | 11/1965 | Maslow |
| D 204,076 | 3/1966 | Maslow |
| 3,288,155 | 11/1966 | Swetnam |
| 3,289,683 | 12/1966 | Tomlin |
| D 213,130 | 1/1969 | Keen |
| 3,451,557 | 6/1969 | Stoddard |
| 4,046,261 | 9/1977 | Yake |
| D 254,187 | 2/1980 | Freese |

BRIEF SUMMARY OF THE INVENTION

The present invention is a compartmented, basket-like accessory, configured so as to permit it to be placed in an open area of an automatic dishwashing article rack or tray. The accessory is constructed with perforated top, sides, bottom and compartment walls to allow wash and rinse water to pass freely therethrough and drain freely therefrom. A plurality of smaller compartments in the accessory are each provided with a vertical, prong-like, nipple positioner, configured to receive and hold a nipple component in the proper position for washing and rinsing. Similarly, a plurality of larger compartments are each provided with a vertical, prong-like, ring and cap positioner, configured to receive and hold a ring and cap or just a cap component in the proper position for washing and rinsing.

A detachable top section is provided which serves as a removable lid for the bottom section of the Nipple, Ring and Cap Accessory and has a perforated top and sides to permit free passage of the water. The top section fits snugly onto the opening of the bottom section and when so fastened, cooperates with the nipple positioners, the ring and cap positioners, and the inner compartment walls, to retain the nipples, rings and caps contained therein and to maintain said nipples and caps in proper position for effective washing and rinsing in an automatic dishwashing machine.

OBJECTIVES OF THE INVENTION

The objectives of the present invention are to provide:

(1) an accessory for use in a conventional automatic dishwashing machine for holding the nipple and cap components from infant-feeding bottles for washing and rinsing in such machines;

(2) means associated with such an accessory for holding the nipple and cap components of infant-feeding bottles in proper position for effective washing and rinsing in an automatic dishwashing machine;

(3) means associated with such an accessory for retaining the nipple and cap components from infant-feeding bottles in proper position for effective sanitization within the accessory during washing and rinsing in an automatic dishwashing machine;

(4) means associated with such an accessory for securing said accessory to a conventional automatic dishwashing machine article rack or tray during the washing and rinsing cycle yet permitting the ready removal of said accessory after the sanitization of the nipples and cap components has been completed;

Other objectives and advantages of the present invention will be apparent during the course of the following detailed description.

BRIEF DESCRIPTION OF DRAWINGS

FIG. 1 is a perspective view of a Nipple, Ring and Cap Washing Accessory constructed in accordance with the principles of the present invention, showing the Accessory secured in place in an article rack or tray of an automatic dishwashing machine.

FIG. 2 is a sectional view of the present invention taken substantially along line 2—2 of FIG. 1, showing in more detail the inner compartment and the top section detached from the bottom section.

FIG. 3 is a plan view of the present invention with its top section detached from the bottom section showing in more detail the compartments with the nipples and cap components shown therein.

FIG. 4 is a sectional end view of the present invention, taken along line 4—4 of FIG. 2, showing the Nipple, Ring and Cap Washing Accessory with the top section attached and with the cap components in place for washing in an automatic dishwashing machine. In the left hand compartment a snap-on cap and ring assembly is shown. In the right hand compartment a cap for ring insert assembly is shown with a pin spacer separating the two components.

FIG. 5 is a sectional end view of the present invention. taken along line 5—5 of FIG. 2, showing the Nipple, Ring and Cap Washing Accessory with the top section attached and with the nipples in place for washing in an automatic dishwashing machine.

FIG. 6 is a perspective view of a pin spacer mounted on a ring and cap positioner where it serves to keep a non snap-on cap apart from its non snap-on ring during the washing and rinsing cycle.

DETAILED DESCRIPTION OF THE PREFERRED EMBODIMENT OF THE INVENTION

The Nipple, Ring and Cap Washer Accessory of the present invention includes a bottom section of perforated construction provided with means for properly orienting the nipple and cap components, commonly used with infant-feeding bottles, for washing and rinsing in automatic dishwashing machines. Also included is a detachable top section of perforated construction which, in cooperation with the orienting means provided in the bottom section, securely maintains nipple and cap components in proper orientation within the Nipple, Ring and Cap Washing Accessory during washing and rinsing cycles of the automatic dishwashing machine. Throughout the following detailed description of the present invention, like reference numerals are used to denote like parts, disclosed in the accompanying drawings FIGS. 1–6.

As shown in FIG. 1, the Nipple, Ring and Cap Washing Accessory of the the present invention, indicated generally by reference numeral 10 is configured for use in article rack 11 of an automatic dishwashing machine. As can be seen more clearly in FIG. 2, Nipple, Ring and Cap Washing Accessory 10 includes bottom section, shown generally by reference numeral 12, and top section, shown generally by reference numeral 13, which fits snugly over the open top of bottom section 12 but may be easily detached therefrom by grasping the sides of top section 13 in ones hand and lifting it clear of bottom section 12.

As may be seen in FIGS. 2 and 3, bottom section 12 has a flat base 14, preferably formed as an open lattice, or in the alternative, formed of perforated plastic sheeting. As shown in FIG. 3, flat base 14 has a narrowed portion, shown generally at reference numeral 15, which abuts a wider portion, shown generally at reference numeral 16. Short front wall 17 extends upwardly from the front edge of narrow portion 15 of flat base 14 to form the front outer wall of bottom section 12. High rear wall 18 extends upwardly from the rear edge of wider portion 16 of flat base 14 to form the rear outer wall of bottom section 12, parallel to short front wall 17. Short side wall 19 and short side wall 20 extend upwardly from the long edges of narrow portion 15 of flat base 14 to abut perpendicularly with short front wall 17 to enclose the three sides of narrow portion 15 of flat base 14.

A main transverse wall 21, extends upwardly along the abutting edge between narrow portion 15 and wide portion 16 of flat base 14. Main transverse wall 21 abuts perpendicularly with short side wall 19 and short side wall 20, opposite their abutment to short front wall 17, so as to enclose the fourth side of narrow portion 15 of flat base 14, and extends outwardly from short side wall 19 and short side wall 20 conforming in length to the abutting edge of wide portion 16 of flat base 14. High side wall 22 and high side wall 23 extend upwardly from the long edges of wide portion 16 of flat base 14 and abut perpendicularly at their front edges with the ends of main transverse wall 21 and at their rear edges with the ends of high wall 18 to enclose completely the four sides of wide portion 16 of flat base 14.

Thus, main transverse wall 21 divides the enclosed sides of abutting narrow portion 15 and wide portion 16 of flat base 14 into narrow main compartment, indicated generally at reference numeral 24, and wide main compartment, indicated generally at reference numeral 25. Narrow main compartment 24, is enclosed by short front wall 17, short side wall 19 and short side wall 20, and main transverse wall 21. Wide main compartment 25 is enclosed by high rear wall 18, high side wall 22 and high side wall 23, and main transverse wall 21. Obviously, narrow main compartment 24 and wide main compartment 25 could be manufactured separately and subsequently joined together to form bottom section 12. As shown in FIG. 5, narrow main compartment 24, which houses nipple 26 and nipple 27, is further subdivided into nipple compartments 28 by low center divider 29 which is the same height as short side wall 19 and short side wall 20 and extends down the center of narrow main compartment 24 from short front wall 17 back to main transverse wall 21. Similarly, as shown in FIG. 4, wide main compartment 25, which houses snap-on cap and ring 30 and cap for ring insert 31, is further subdivided into cap and ring compartments 32, by high center divider 33 which is the same height as high side wall 22 and high side wall 23 and extends down the center of wide main compartment 25 from main transverse wall 21 back to high rear wall 18.

Centered in each of nipple compartments 28 is a prong-like, nipple positioner 34 which extends upwardly from flat base 14 to a height slightly less than the height of short side wall 19 and short side wall 20. Nipples, such as nipple 26 and nipple 27, slip over, and are suspended by, nipple positioner 34 in preparation for the washing and rinsing cycle. When top section 13 is in place atop bottom section 12, there is only a fraction of one inch clearance remaining between the top of said nipples, such as nipple 26 and nipple 27, and the underside of top section 13.

Centered in each of cap and ring compartments 32 is a prong-like, cap and ring positioner 35 which extends upwardly from flat base 14 to a height slightly less than the height of high side wall 22 and high side wall 23. Cap and ring components, such as snap-on cap and ring 30 and cap for ring insert 31, slip over, and are suspended by, cap and ring positioner 35 in preparation for the washing and rinsing cycle. When top section 13 is in place atop bottom section 12, there is only a fraction of one inch clearance between the top of the cap of said cap and ring components, such as snap-on cap and ring 30 and cap for ring insert 31, and the underside of top section 13.

To secure the front end of Nipple, Cap and Ring Washer Accessory 10 to article rack 11, front hook 36 and front hook 37, preferably made of plastic and elastic or other suitable materials, are mounted on the front edge of top section 13 of such length as to just reach front rail 38 when said front hook 36 and front hook 37 are stretched to their maximum length. Similarly, to secure the rear end of Nipple, Cap and Ring Washer Accessory 10 to article rack 11, rear hook 39 and rear hook 40, preferably made of plastic and elastic or other suitable materials, are mounted on the rear edge of top section 13 of such length as to just reach rear rail 41 when said rear hook 39 and rear hook 40 are stretched to their maximum length.

Cap and ring components, such as snap-on cap and ring 30, pose no problem of nesting during the washing and rinsing cycle, because their structure prevents the cap and ring from coming together unless considerable force is applied to snap them together. On the other hand, cap and ring components, such as cap for ring insert 31 and ring insert 43, do pose a nesting problem as they may mesh together during the washing and rinsing cycle, thereby blocking the free movement of water around and through the cap and ring components. To prevent this problem, pin spacer 42 is provided, which can be slipped over cap and ring positioner 35 after ring insert 43 has first been positioned thereon. Pin spacer, indicated generally at reference numeral 42, has two dowel-like projections which extend 180° from central mounting hub 44 of sufficient length to slightly exceed the bottom diameter of cap for ring insert 31, thus preventing the two components, cap for ring insert 31 and ring insert 43 from nesting. The use of pin spacer 42 under such circumstances permits all surfaces to be exposed for thorough sanitization.

As best illustrated in FIG, 1, Nipple, Cap and Ring Washer Accessory 10 can be loaded outside of the automatic dishwasher and top section 13 fitted onto bottom section 12 merely by downward pressure upon the upper surface of top section 13. Nipple, Cap and Ring Washer Accessory 10 can then be easily lifted by hand and placed in article rack 11 or any other convenient place in the automatic dishwashing machine. Front hook 36 and front hook 37 can then be snapped into place to secure the front of said Accessory to front rail 38 or any nearby rack component. Similarly, rear hook 39 and rear hook 40 can be quickly snapped in place on rear rail 41 or any nearby rack component. After the washing and rinsing cycle, said Accessory can be left in the automatic dishwasing machine until the contents are dry and then said Accessory can be removed quickly by reversing the steps described above. Said Accessory serves as a handy storage container for the nipple and cap components until needed.

I claim:

1. An accessory for use in a conventional automatic dishwashing machine for holding the nipples and the ring and cap components of infant feeding bottles, comprising, in combination:

a perforated, rectangular, open top, bottom section, having front and rear walls, main transverse wall, opposed side walls and a flat base; and a plurality of spaced apart prong-like positioning means attached to and extending upwardly from said flat base, arrange in a plurality of spaced apart rows, each positioning means adapted to receive thereover a nipple or associated ring and cap components to hold them in a fixed position during the dishwashing machine cycles; and a perforated top section having means for engaging and closing the open top of said bottom section to confine said nipple and ring and cap components positioned within said bottom section; and securing means attached to said accessory for fastening said accessory at front and rear walls to an article rack of said conventional automatic dishwashing machine.

2. The accessory of claim 1 wherein said securing means is attached to said perforated top section whereby said top section constrains said bottom section as said accessory is fastened to said article rack.

3. The accessory of claim 2 wherein said securing means comprises hooks attached to front and rear edges of said top section by elastic members to provide quick and easy attachment to said dishwasher rack.

4. The accessory of claim 1, further comprising spacing means adapted to slide over said prong-like positioning means between said ring and cap components to keep said components from nesting during said dishwashing machine cycles.

5. The accessory of claim 4 wherein said spacing means for keeping said ring and cap components from nesting together during said dishwashing machine cycles comprises a pin spacer having a central mounting hub which slips over said prong-like positioning means and has two dowel-like projections, which extend 180 degrees from said central mounting hub, of sufficient length to slightly exceed the bottom diameter of a cap for ring insert.

6. The accessory of claim 1 wherein said perforated rectangular bottom section has a narrow nipple containing portion and a wide ring and cap component containing portion, the spacing between said spaced apart prong-like positioning means and said rows thereof being less in said nipple containing portion than the spacing in said ring and cap component containing portion, and wherein said perforated top section has a wide and a narrow portion to conform with said bottom section portions.

7. The accessory of claim 6 wherein the front wall and the portions of said opposed side walls defining the narrow nipple containing portion of said bottom section are shorter than the rear wall and the portions of said opposed side walls defining the wide, ring and cap component containing portion, to define a stepped height bottom section with the lower portion being the nipple containing portion and the higher portion being the ring and cap component containing portion; wherein said perforated top section has a conforming stepped height; and wherein said prong-like positioning means are shorter in said nipple containing portion and higher in said cap and ring component containing portion.

8. The accessory of claim 7 wherein the narrow shorter nipple containing portion is subdivided into a plurality of smaller nipple compartments, and the wide ring and cap component containing portion is subdivided into a plurality of larger ring and cap component compartments, and wherein said respective prong-like positioning means are centered in each of said subdivided compartments whereby the nipples are individually housed in smaller compartments and the ring and cap components are individually housed in larger compartments.

* * * * *